US008164541B2

(12) United States Patent
Van Der Poel

(10) Patent No.: US 8,164,541 B2
(45) Date of Patent: Apr. 24, 2012

(54) ARRAY ANTENNA COMPRISING MEANS TO SUPPRESS THE COUPLING EFFECT IN THE DIELECTRIC GAPS BETWEEN ITS RADIATOR ELEMENTS WITHOUT ESTABLISHING GALVANIC CONTACTS

(75) Inventor: Stephanus Hendrikus Van Der Poel, Haaksbergen (NL)

(73) Assignee: Thales Nederland B.V., Hengelo (NL)

( * ) Notice: Subject to any disclaimer, the term of this patent is extended or adjusted under 35 U.S.C. 154(b) by 432 days.

(21) Appl. No.: 12/545,675

(22) Filed: Aug. 21, 2009

(65) Prior Publication Data

US 2010/0053025 A1 Mar. 4, 2010

(30) Foreign Application Priority Data

Aug. 28, 2008 (NL) ..... 1035877

(51) Int. Cl.
*H01Q 21/00* (2006.01)

(52) U.S. Cl. ..... 343/893; 343/700 MS; 343/776

(58) Field of Classification Search ..... 343/908, 343/893, 841, 776, 778, 786
See application file for complete search history.

(56) References Cited

U.S. PATENT DOCUMENTS 5,579,020 A * 11/1996 Kinsey ..... 343/776
6,876,323 B2 * 4/2005 Feldle et al. ..... 342/175

* cited by examiner

*Primary Examiner* — Jacob Y Choi
*Assistant Examiner* — Kyana R McCain
(74) *Attorney, Agent, or Firm* — Stroock & Stroock & Lavan LLP

(57) ABSTRACT

A plurality of three-dimensional radiator elements, each radiator element transmitting or receiving electromagnetic waves by a radiating top side. The radiator elements are arranged so that their radiating top sides are substantially parallel and so that at least one pair of adjacent radiator elements are separated by a dielectric gap between sidewalls, the gap behaving like a waveguide which couples electromagnetic interferences with the electromagnetic waves. The adjacent radiator elements further comprise a structure to suppress the coupling effect without establishing a galvanic contact with its adjacent radiator element.

8 Claims, 3 Drawing Sheets

Figure 1:
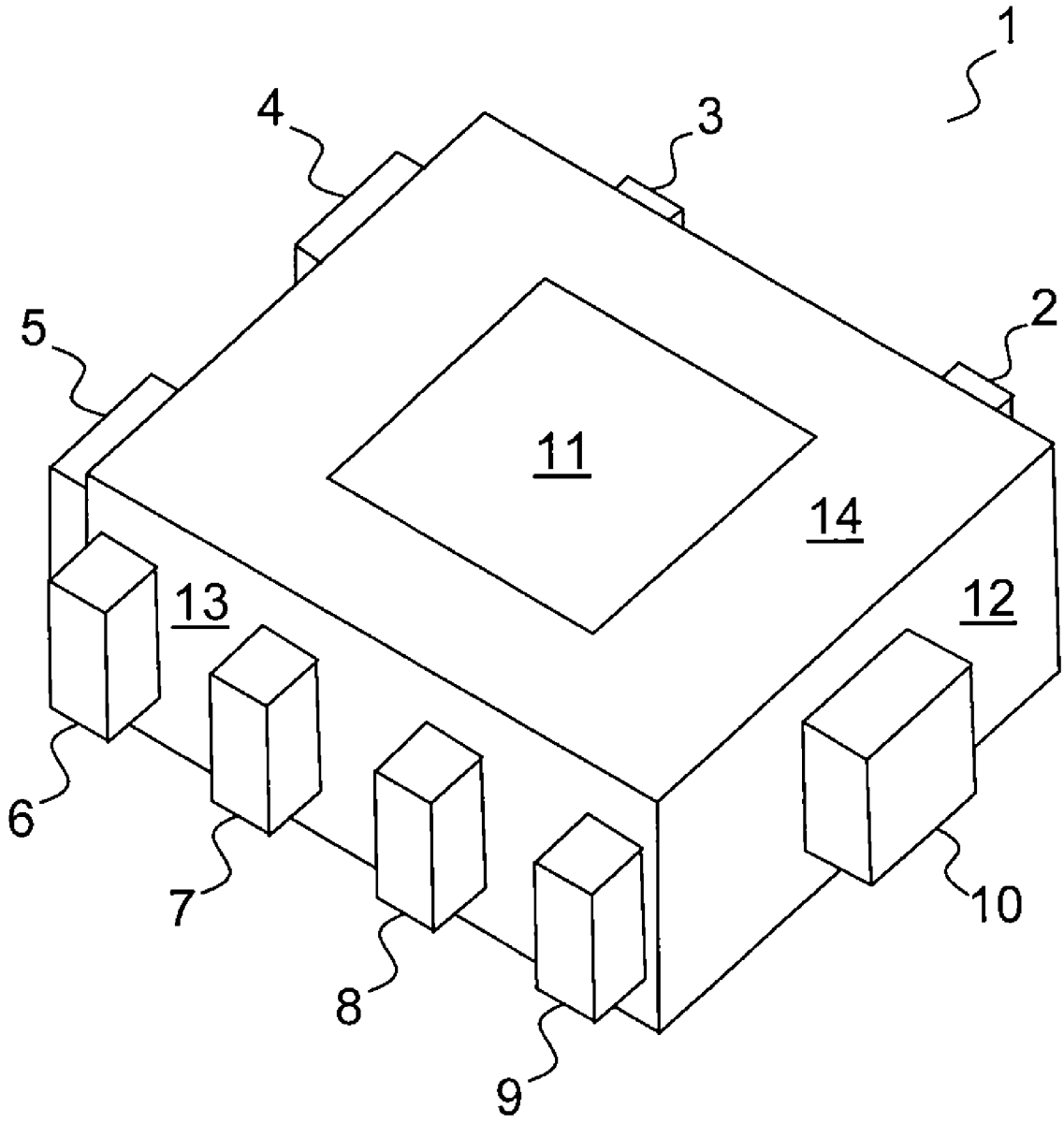

ARRAY ANTENNA COMPRISING MEANS TO SUPPRESS THE COUPLING EFFECT IN THE DIELECTRIC GAPS BETWEEN ITS RADIATOR ELEMENTS WITHOUT ESTABLISHING GALVANIC CONTACTS

The present application claims the benefit of Dutch Patent Application No. 1035877, filed Aug. 28, 2008, which hereby is incorporated by reference in its entirety.

The present invention relates to an apparatus for suppressing the coupling effect in the dielectric gaps between the radiator elements of an array antenna, without establishing galvanic contacts. For example, the invention is particularly applicable to antenna modules for radar and telecom.

Nowadays radar systems may use a scanning phased array antenna to cover their required angular range. Such an antenna comprises a large number of identical radiator elements assembled onto a panel so as to form a grid of radiator elements. The control of the phase shifting between adjacent radiator elements enables to control the scanning angle of the beam emitted by the array antenna. The techniques that are the most commonly used to build an array antenna are based on interconnect substrate technologies, e.g. the Printed Circuit Board technology (PCB). These thick-film or thin-film multilayer technologies consist in many sequential steps of laminating layers, of drilling holes through the layers and of metallizing the holes. These sequential build-up technologies typically result in planar interconnect devices comprising multiple interconnection layers. However, the next generation of compact scanning phased array antennas require Radio-Frequency (RF) radar functionalities to be implemented directly at the antenna face, such as Active Electronically Scanned Array (AESA) antennas for example. This cannot be achieved by the above mentioned techniques, as they typically result in planar interconnect devices that do not afford extra room to embed the required RF components. This is one of the technical problems that the present invention aims at solving.

The use of 3D-shaped radiator elements, so-called radiator packages, may afford sufficient extra interior room. It is worth noting that a 3D radiator package also yields design possibilities in terms of bandwidth and scan-angle that a planar device radiator cannot. The general aspect of a radiator package is that of a hollowed box topped by an integrated antenna. A large number of freestanding radiator packages are assembled onto a PCB so as to form a grid of radiator packages, by picking and placing them onto the board as surface mounted devices (SMD). So-called "unit cells" are used as footprints to mount the radiator packages onto the PCB. A unit cell determines the space available for each radiator package onto the PCB. The width and the length of a unit cell is determined by the type of grid (rectangular grid or triangular grid) and by the required performance, in terms of free space wavelength and of scanning requirements. Units cells are printed at the surface of the PCB according to a triangular grid pattern or a rectangular grid pattern, thus providing a convenient mean to arrange the radiator packages onto the PCB. Unfortunately, gaps are left between the radiator packages. The depth of these gaps is equal to the height of a unit cell, which is determined by the dimensions and the layout of the RF components that must be embedded inside the radiator elements. Consequently, the depth of the gaps cannot be adjusted.

Basically, these gaps result from the necessary tolerances required by the process of placing and assembling the radiator packages. Practically, the width of the gaps can be limited to a minimum, as long as it allows for placement on the PCB and as long as it allows for thermal expansion and cooling of the radiator packages. Thus, doing without the gaps is not workable. Unfortunately, these "mechanical gaps" incidentally form "RF gaps" or "dielectric gaps" behaving like waveguides, into which the electromagnetic energy radiated by the packages partly couples. Reflected in the bottom of the gaps by the PCB, undesired interference with the directly emitted energy into free space are generated. Depending on the height of the radiator packages and on the wavelength, the gaps may induce mismatch scanning problems for some of the required scanning angle, for example the scanning angles up to 60 degrees in all directions. This is another technical problem that the present invention aims at solving. It is worth noting that, in a large bandwidth antenna, minimizing the width of the gaps may only alleviate the problem. Minimizing the width of the gaps cannot solve the problem.

An existing solution consists in an array of radiator packages attached to a board by means of conducting bolts. The boltheads short-circuit the conductive sidewalls of the adjacent radiator packages by virtue of contact shims, thus suppressing undesired waveguide modes inside the gaps. However, if the array antenna comprises a lot of radiator packages, this solution leads to a very complex assembly, which is bound to hamper any later maintenance or repair operation. Actually, removing an individual radiator element may turn into a challenge in regard of the very high level of integration of nowadays systems, as it implies unscrewing several bolts with special tools and handling with tiny shims. Another major disadvantage of this solution is that the use of bolts inserted between the radiator elements do not allow for proper thermal expansion, thus requiring the use of an additional high-performance cooling system. These are other technical problems that the present invention aims at solving.

In an attempt to provide a radar system that requires little room whereas the radiator packages are easily interchangeable for maintenance or repair work, the U.S. Pat. No. 6,876,323 discloses a radar system with a phase-controlled antenna array. The disclosed system comprises a plurality of data and supply networks interchangeably arranged and a plurality of transmit/receive modules (e.g.: 3D radiator packages) arranged interchangeably on a radiation side of the radar system. The sender/receiver modules are said to be exchangeable either from the irradiation side or from the front side of the radar system equally. However, the disclosed system comprises narrow gaps between the exchangeable sender/receiver modules, these gaps necessarily behaving like waveguides into which the electromagnetic energy radiated couples. Consequently, the system disclosed in the U.S. Pat. No. 6,876,323 is not adapted to angular scanning.

The present invention aims to provide an apparatus which may be used to overcome at least some of the technical problems described above. The present invention provides a virtual reflecting boundary, which suppresses electromagnetic fields in the gaps between the radiator packages, without the need for galvanic contacts between the individual radiator packages. At its most general, the present invention described hereafter may provide an apparatus comprising a plurality of three-dimensional radiator elements, each radiator element transmitting or receiving electromagnetic waves by its radiating top side. The radiator elements are arranged so that their radiating top sides are parallel and so that at least one pair of adjacent radiator elements are separated by a dielectric gap between sidewalls, the gap behaving like a waveguide which induces by a coupling effect electromagnetic interferences with the waves. Each of said adjacent radiator elements comprises means to suppress the coupling effect without establishing a galvanic contact with its adjacent radiator element.

In a preferred embodiment, the means to suppress the coupling effect may comprise corrugations arranged at the sidewall facing the gap, the corrugations being arranged so as to interlace with the corrugations of the adjacent radiator element, without establishing a mechanical contact.

Advantageously, the sidewall facing the gap and its corrugations may be metallized.

For example, the three-dimensional radiator elements may be mounted onto a printed circuit board by their bottom sides opposite to their radiating top sides, the radiating top sides being in a same plan so as to form an array of three-dimensional radiator elements.

For example, the three-dimensional radiator elements may be all identical, arranged so as to form an array of the triangular type.

Advantageously, the corrugations may be orthogonal to the radiating top sides, so that each radiator element can be independently picked out from the printed circuit board.

For example, the array of three-dimensional radiator elements may be part of a scanning phased array antenna.

In any of its aspects, the invention disclosed herein conveniently provides a true pick and place solution of the SMD type, which enables to easily assemble individual 3D radiator packages together in an array configuration. It allows for easy placement of the 3D radiator packages on a PCB, for thermal expansion and for cooling. Implemented in a scanning phased array antenna, it allows for large scan angles without mismatch scanning problems and it allows for large bandwidth performance. Exchanging an individual 3D radiator element does not require an unusual effort, especially because the radiator elements are not in contact.

Figure 2:
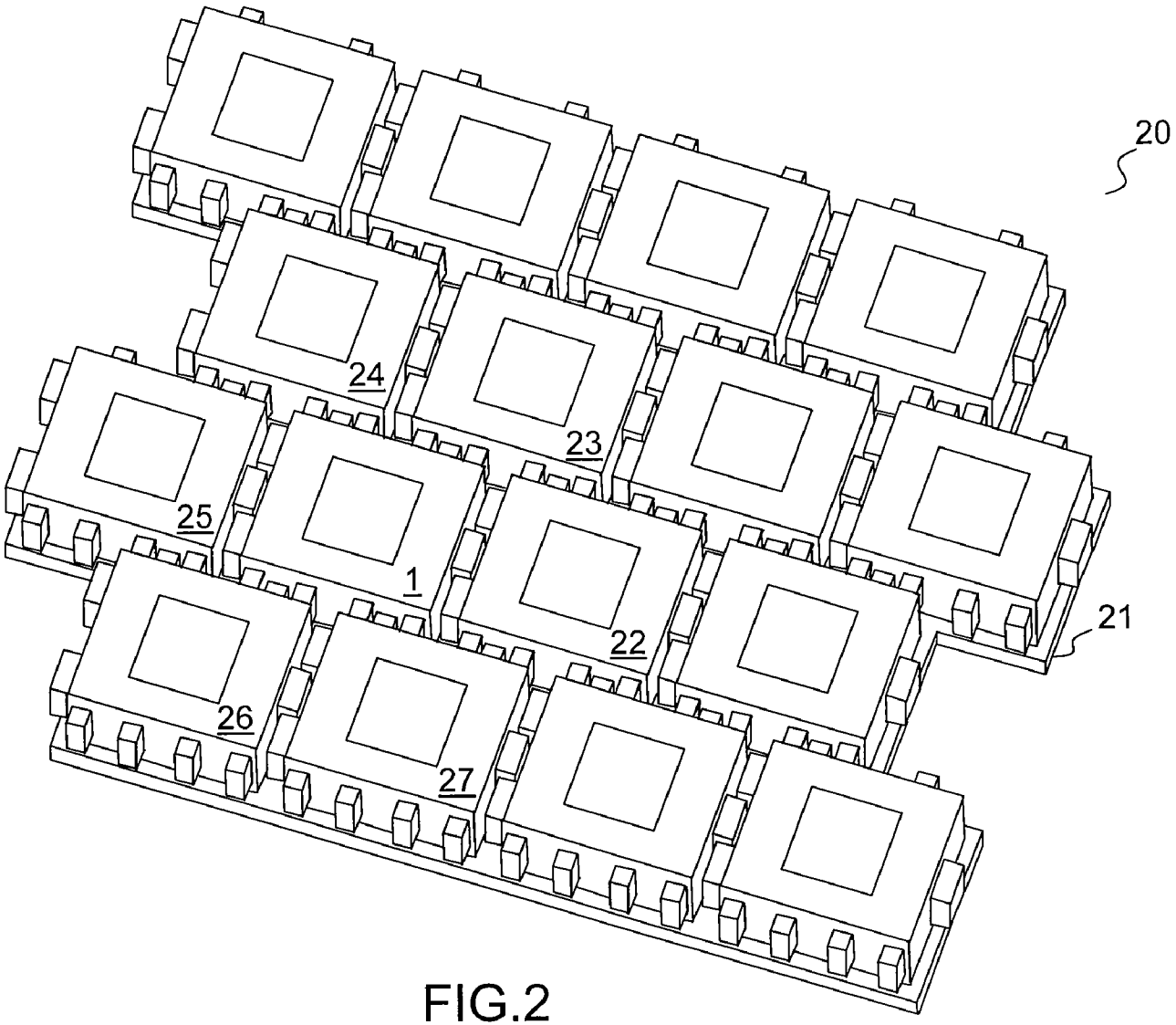
Figure 3:
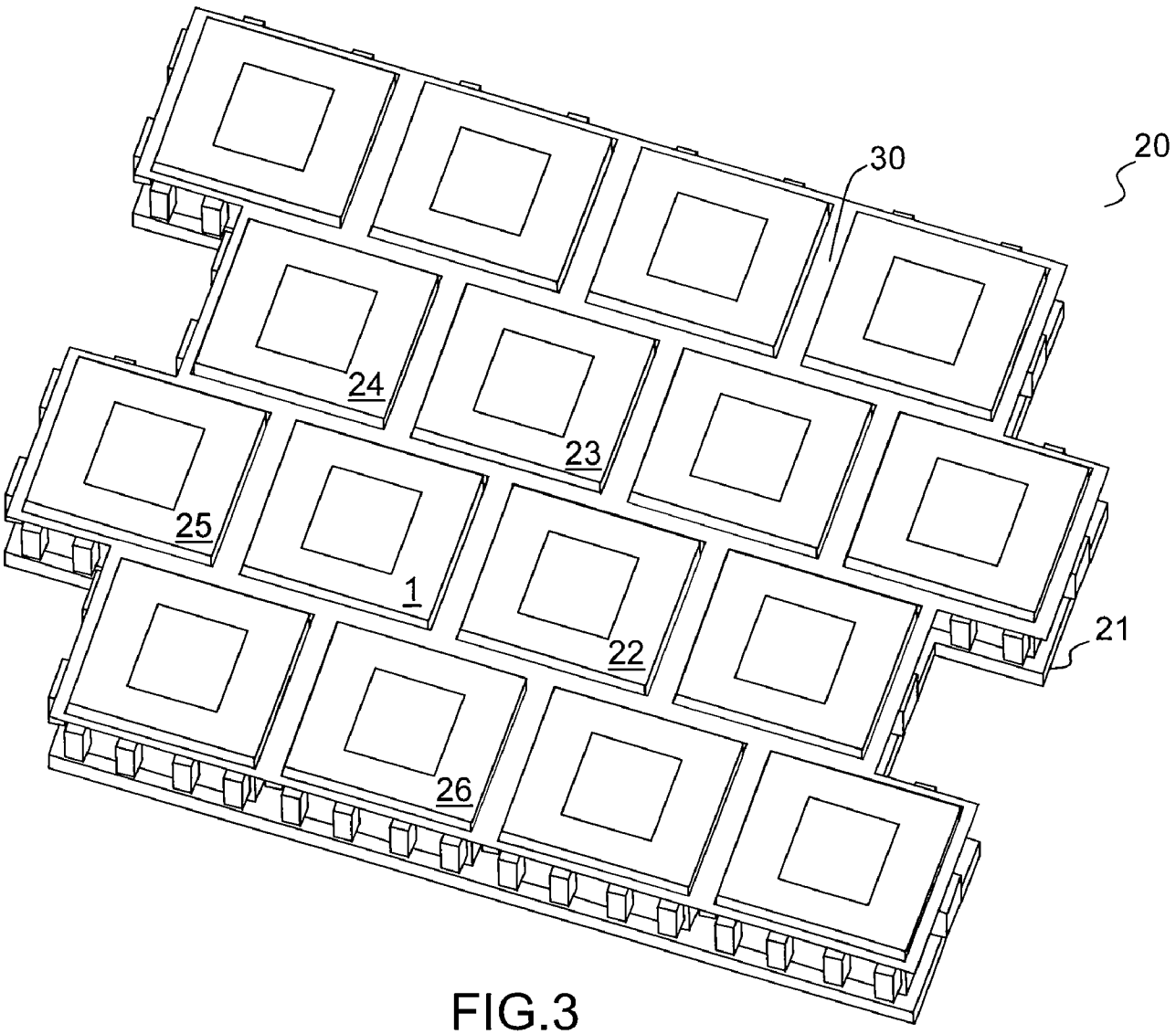

A non-limiting exemplary embodiment of the invention is described below with reference to the accompanying drawings in which:

the FIG. 1 schematically illustrates by a perspective view an exemplary 3D radiator package with corrugations according to the invention;

the FIG. 2 schematically illustrates by a perspective view an exemplary 4×4 array of 3D corrugated radiator packages according to the invention;

the FIG. 3 schematically illustrates by a perspective view an exemplary virtual reflecting boundary provided by the invention.

FIG. 1 schematically illustrates by a perspective view an exemplary 3D radiator package 1, which may emit and/or receive electromagnetic waves. The radiator package 1 may be fabricated by different technologies. For example, LTCC technology (Low-Temperature, Cofired Ceramic) or 3D MID technology (3-Dimensional Molded Interconnect Device technology) are suitable. The radiator package 1 comprises at its radiating top side 14 a patch antenna 11. In the illustrated embodiment, the four sidewalls of the radiator package 1, including a sidewall 12 and a sidewall 13, may advantageously be corrugated. A parallelepiped-shaped corrugation 10 may be arranged at the sidewall 12, its longitudinal axis being advantageously orthogonal to the radiating top side 14. Two parallelepiped-shaped corrugations 4 and 5 may be arranged at a sidewall opposite to the sidewall 12, not viewable on FIG. 1, their longitudinal axis being advantageously orthogonal to the radiating top side 14. The corrugations 10 may be sized and arranged so as to be facing the space between the corrugations 4 and 5 on the opposite sidewall. Four parallelepiped-shaped corrugations 6, 7, 8 and 9 may be arranged at the sidewall 13, their longitudinal axis being advantageously orthogonal to the radiating top side 14. Two parallelepiped-shaped corrugations 2 and 3 may be arranged at a sidewall opposite to the sidewall 13, not viewable on FIG. 1, their longitudinal axis being advantageously orthogonal to the radiating top side 14. The corrugations 2 may be sized and arranged so as to be facing the space between the corrugations 8 and 9 on the opposite sidewall. The corrugations 3 may be sized and arranged so as to be facing the space between the corrugations 6 and 7 on the opposite sidewall. Advantageously, the four sidewalls of the radiator package 1 may be metallized, including the corrugations 2, 3, 4, 5, 6, 7, 8, 9 and 10. In the illustrated embodiment, combining in an array several 3D radiator packages identical to the radiator package 1 may advantageously result in interlacing the metallized corrugations of adjacent radiator packages, so as to form a structure crept into the dielectric gap between the adjacent radiator packages, as illustrated by FIG. 2. The so-formed crept structure enables to solve the problem of detrimental scanning mismatch due to the dielectric gap between free-standing 3D radiator packages, when 3D radiator packages are combined in an array antenna for example.

FIG. 2 schematically illustrates by a perspective view an exemplary 4×4 array 20 of sixteen 3D corrugated radiator packages identical to the radiator package 1, advantageously arranged in a triangular grid onto a PCB 21 according to the invention. For example, the radiator packages 1, 22, 23, 24, 25, 26 and 27 may be bonded onto the PCB 21 by their side opposite to their radiating top side, so that their radiating top sides are advantageously in a same plan. For the sake of clarity, the same references 2, 3, 4, 5, 6, 7, 8, 9 and 10 are used to identify the metallized corrugations, independently from the radiator package specifically considered. Advantageously, the metallized corrugation 10 of the radiator package 1 may be sized and arranged so as to allow easy interlacing with the metallized corrugations 4 and 5 of a single adjacent radiator package 22. The metallized corrugations 2 and 3 of the radiator package 1 may be sized and arranged so as to allow easy interlacing with the metallized corrugations 6 and 7 of an adjacent radiator packages 23 and with the metallized corrugations 8 and 9 of an adjacent radiator package 24. The metallized corrugations 4 and 5 of the radiator package 1 may be sized and arranged so as to allow easy interlacing with the metallized corrugation 10 of a single adjacent radiator package 25. The metallized corrugations 6, 7, 8 and 9 of the radiator package 1 may be sized and arranged so as to allow easy interlacing with the metallized corrugation 2 of an adjacent radiator packages 26 and with the metallized corrugation 3 of an adjacent radiator packages 27. It is worth noting that the radiator package 1 is neither in contact with the radiator package 22, nor in contact with the radiator package 23, nor in contact with the radiator package 24, nor in contact with the radiator package 25, nor in contact with the radiator package 26, nor in contact with the radiator package 27. The radiator package 1 is separated from those adjacent packages 22, 23, 24, 25, 26 and 27 by a non-linear 'mechanical gap'. Hereby, the electromagnetic field must meander into the non-linear gap between the metallized corrugations, with a weaker coupling than it would propagate in a linear gap.

FIG. 3 schematically illustrates by a perspective view an exemplary virtual reflecting boundary 30 provided by the invention. Actually, the top of the corrugations acts like a virtual reflecting boundary, as if the 3D radiator packages were galvanically connected at that level.

It is to be understood that variations to the example described above, such as would be apparent to the skilled addressee, may be made without departing from the scope of the present invention.

Conveniently, the invention disclosed herein leaves free choice of the height of the 3D radiator packages to accommodate the RF components at the inside of the radiator packages.

The invention claimed is:

1. A multiple radiator element apparatus comprising: a plurality of three-dimensional radiator elements, each three-multiple radiator element comprising: a plurality of sidewalls, at least one sidewall having one or more corrugations; an enclosed radiating top surface substantially perpendicular to the plurality of sidewalls, the radiating top surface transmitting or receiving electromagnetic waves, the three-dimensional radiator elements arranged so that their radiating top surfaces are substantially parallel and so that at least one pair of adjacent three-dimensional radiator elements are separated by a dielectric gap between sidewalls of the respective three-dimensional radiator elements, the dielectric gap forming a waveguide that couples an electromagnetic interference with the electromagnetic waves; and each radiator element further comprising a bottom side opposite from the radiating top surface, wherein at least one of the corrugations of one of the three-dimensional radiator elements interlaces with a corrugation of an adjacent three-dimensional radiator element without establishing a mechanical contact between the corrugations of the adjacent three-dimensional radiator element.

2. A multiple radiator element apparatus as claimed in claim 1, wherein the sidewall and its corrugations comprise a metallized surface.

3. A multiple radiator element apparatus as claimed in claim 2, further comprising a printed circuit board, wherein the three-dimensional radiator elements are mounted onto the printed circuit board by their respective bottom sides, the radiating top surfaces arranged to form an array of three-dimensional radiator elements.

4. A multiple radiator element apparatus as claimed in claim 3, wherein the three-dimensional radiator elements are substantially identical.

5. A multiple radiator element apparatus as claimed in claim 4, wherein the three-dimensional radiator elements are arranged to form a triangular array.

6. A multiple radiator element apparatus as claimed in claim 4, wherein the corrugations are orthogonal to the radiating top surfaces, and arranged so that each three-dimensional radiator element can be removed from the printed circuit board without removal of an adjacent three-dimensional radiator element.

7. A multiple radiator element apparatus as claimed in claim 4, wherein the array of three-dimensional radiator elements comprises an array antenna.

8. A multiple radiator element apparatus as claimed in claim 7, wherein the array antenna comprises a scanning phased array antenna.

* * * * *